US005585900A

United States Patent [19]

Lior et al.

[11] Patent Number: 5,585,900

[45] Date of Patent: Dec. 17, 1996

[54] DEVELOPER FOR LIQUID TONER IMAGER

[75] Inventors: Ishaiau Lior, Nes Ziona; Amiran Lavon, Bat Yam, both of Israel; Benzion Landa, Edmonton, Canada

[73] Assignee: Indigo N.V., SM Veldhoven, Netherlands

[21] Appl. No.: 470,758

[22] Filed: Jan. 26, 1990

Related U.S. Application Data

[63] Continuation-in-part of Ser. No. 351,546, May 15, 1989.

[51] Int. Cl.[6] ..... G03G 15/10; G03G 15/01

[52] U.S. Cl. ..... 355/256; 355/320 R; 118/659

[58] Field of Search ..... 355/256, 298; 354/318, 325; 118/645, 659, 660, 661

[56] References Cited

U.S. PATENT DOCUMENTS

| | | | |
|---|---|---|---|
| 3,405,683 | 10/1968 | Jons et al. | 118/659 |
| 3,687,708 | 8/1972 | Miller | 355/256 X |
| 3,701,337 | 10/1972 | Borelli et al. | 118/652 |
| 3,806,355 | 4/1974 | Kaufman | 355/256 X |
| 3,900,003 | 8/1975 | Sata et al. | 355/256 X |
| 3,910,231 | 10/1975 | Inoue et al. | 118/652 X |
| 3,921,580 | 11/1975 | Kase | 118/651 |
| 3,965,861 | 6/1976 | Fukushima et al. | 118/661 X |
| 4,073,266 | 2/1978 | Arneth et al. | 118/661 X |
| 4,202,913 | 5/1980 | Klavan et al. | 118/661 X |
| 4,233,385 | 11/1980 | Hinz et al. | 118/659 X |
| 4,342,823 | 8/1982 | Grant et al. | 355/256 X |
| 4,400,079 | 8/1983 | Landa | 355/256 |
| 4,504,138 | 3/1985 | Kuehnle et al. | 355/256 |
| 4,522,484 | 6/1985 | Landa | 355/256 |
| 4,690,539 | 9/1987 | Radulski et al. | 355/256 X |
| 4,794,651 | 12/1988 | Landa et al. | 430/110 |
| 4,799,452 | 1/1989 | Day | 118/645 |

FOREIGN PATENT DOCUMENTS

| | | |
|---|---|---|
| 55-142662 | 2/1980 | Japan . |
| 58-2863 | 1/1983 | Japan . |
| 58-002863 | 1/1983 | Japan . |
| 8700916 | 2/1987 | WIPO . |

*Primary Examiner*—Joan H. Pendegrass
*Attorney, Agent, or Firm*—Greenblum & Bernstein P.L.C.

[57] ABSTRACT

An imaging system including a movable electrostatic imaging surface, apparatus for providing an electrostatic image on the electrostatic image surface and a development electrode having a developer surface with contiguous portions in spaced relationship with the electrostatic imaging surface to form a development region. The system includes apparatus for moving the developer surface such that the contiguous portions of the developer surface sequentially enter the region at an entrance and leaves the development region at an exit, apparatus for moving the electrostatic imaging surface so that it enters the development region at the exit and leaves the region at the entrance and apparatus for providing a liquid developer of a selectable color to the development region at the exit. The system also includes apparatus for transferring the developed image to a substrate.

16 Claims, 14 Drawing Sheets

FIG. 14
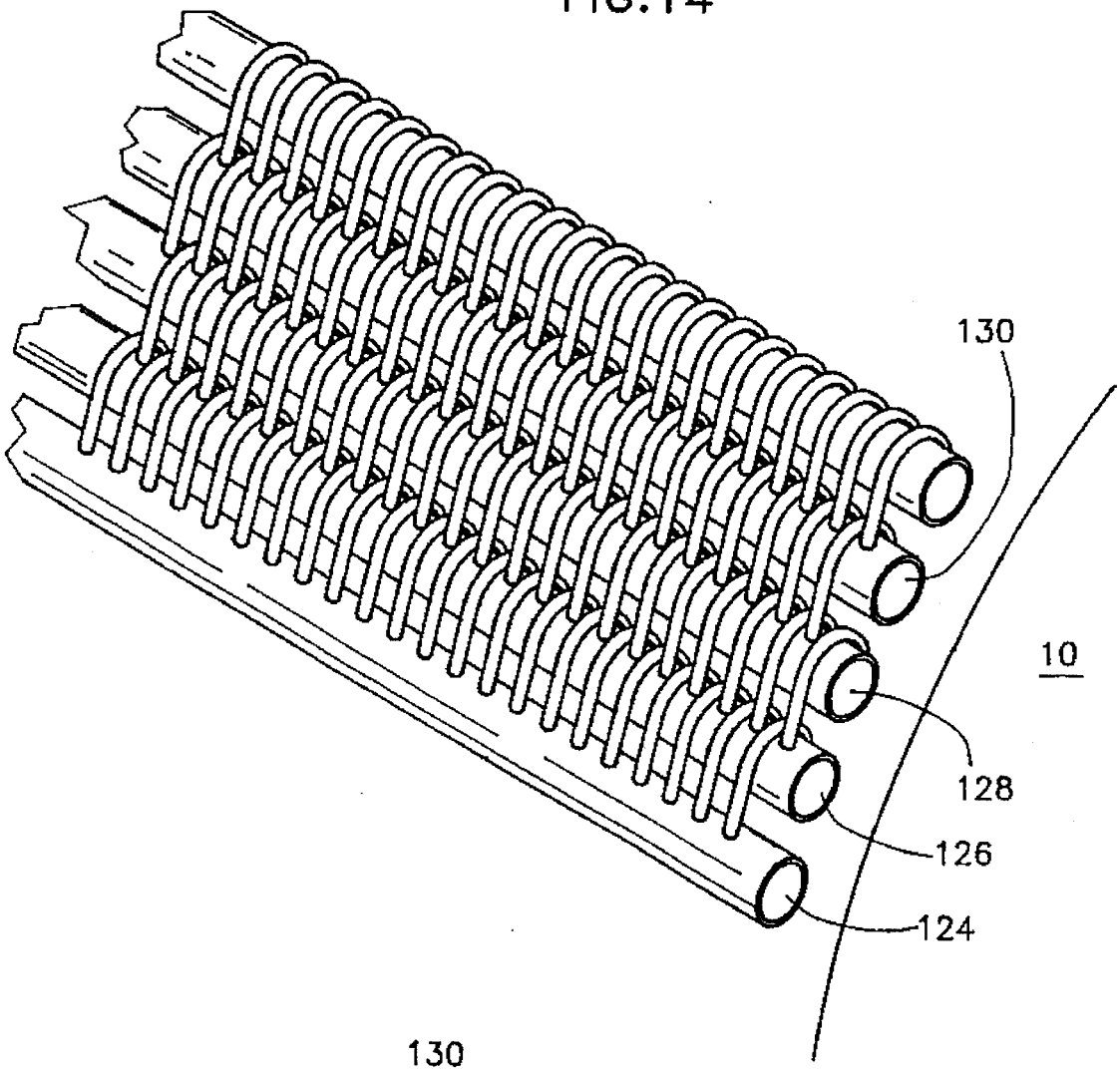
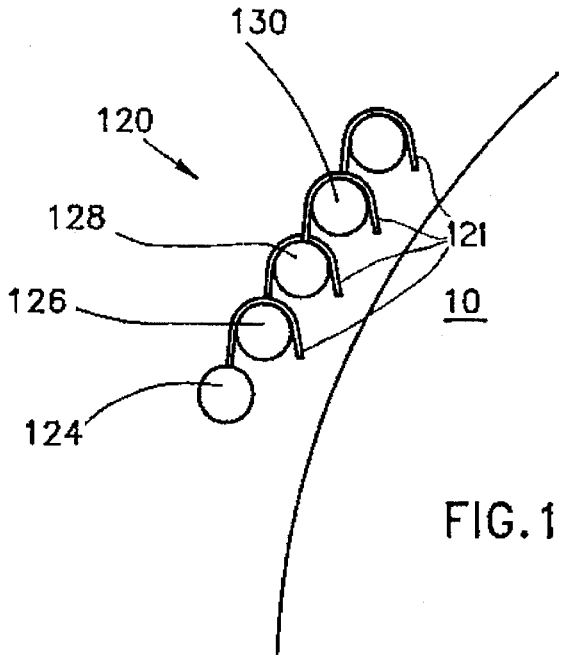
FIG. 13

DEVELOPER FOR LIQUID TONER IMAGER

RELATED APPLICATION

This application is a continuation-in-part application of U.S. Ser. No. 07/351,546 titled COLOR IMAGING SYSTEM which was filed on May 15, 1989.

FIELD OF THE INVENTION

The present invention relates generally to multicolor imaging.

BACKGROUND OF THE INVENTION

Proposals for various types of multicolor imaging apparatus and techniques appear in the patent literature. There is described in Japanese Patent document 58002863 to Kawamura an image recording device for use in a color printer which include nozzle heads which spray liquid coloring toner onto electrostatic latent images on the side of a photosensitive drum and thus develop images thereon. A single nozzle is provided for each color and the nozzles reciprocate along a nozzle guide. Alternating current apparatus is disposed between the nozzle and the drum in order to spread out the impingement area of the toner on the drum.

U.S. Pat. NO. 4,690,539 describes transfer apparatus in which a plurality of liquid images are transferred from a photoconductive member to a copy sheet. The liquid images, which include a liquid carrier having toner particles dispersed therein, are attracted from the photoconductive member to an intermediate web. A substantial amount of the liquid carrier is removed from the intermediate web and the toner particles are secured thereon. Thereafter, another liquid image having toner particles of a different color from the toner particles of the first liquid image is attracted to the intermediate member. Once again the liquid carrier material is removed from the web and the toner particles of the second liquid image are secured thereon. Thereafter, all of the toner particles are transferred from the intermediate member to the copy sheet, in image configuration.

U.S. Pat. No. 3,900,003 describes a liquid developing device for use in multicolor electrophotographic copying machines, having a plurality of feed pipes for supplying different liquid color developers to a developing station, which feed pipes are connected to a common developer supply pipe. Valves are provided in the feed pipes wherein each of the valves are actuated by an electrical signal to supply only one selected liquid color developer to the developing station at a time. The liquid developing device is also provided with a belt for removing residual liquid developer remaining on an image bearing member after development and with a plurality of blades for scraping and collecting the thus removed liquid developer, which are selected and actuated in correspondence with a selected color.

U.S. Pat. No. 4,504,138 describes a method and apparatus for developing electrostatic latent images formed on a photoconductor surface comprising the steps of applying a thin viscous layer of electrically charged toner particles to an applicator roller preferably by electrically assisted separation thereof from a liquid toner suspension. A restricted passage is defined between the applicator roller and the photoconductor surface approximately the thickness of the viscous layer and the toner particles are transferred from the applicator roller to the photoconductor surface due to their preferential adherence to the photoconductor surface under the dominant influence of the electric field of the electrostatic latent image carried by the photoconductive surface.

U.S. Pat. No. 4,400,079 describes a developing system for an electrophotographic copier in which a roller having a conductive outer surface is disposed adjacent to the imaging surface to form a gap. The roller is driven at a peripheral linear velocity substantially greater than the velocity of movement of the imaging surface and is supplied with liquid developer at a location spaced from the gap to cause the roller to inject the developer into the gap. The roller is coupled to a source of electrical potential.

U.S. Pat. No. 4,342,823 describes a perforate development electrode and a method for developing electrostatic images directly on a final image bearing sheet, formed of electrophotographic material coated onto a substrate, by means of a perforate development electrode and liquid toner, without immersing the material in a bath of toner. The method comprises spraying liquid toner against pressure reducing means adjacent to the electrode to reduce and make uniform the pressure of the flowing liquid toner and flowing the liquid toner uniformly over and through the perforate development electrode and over the image side of the sheet without contacting the side opposite the image side with the toner.

U.S. Pat. No. 4,233,385 describes a method of liquid development of charge images formed on a surface of a tape-like record carrier, for example by an electrostatic printer. The record carrier is simultaneously sprayed with developer liquid in two flows which are directed towards each other. As a result two separate, uniform and oppositely directed flow zones meeting at one common turbulent flow zone are obtained. Both during pre-development and final development the charge images are brought into contact with a large quantity of fresh developer liquid.

U.S. Pat. No. 4,073,266 describes apparatus for developing a latent electrostatic image on an electrophotographic copying material by means of a toner dispersion. An infeed roller applies the toner dispersion to the copying material and downstream thereof, a distribution roller acts on the surface of the copying material. Squeegee rollers downstream of the distribution roller effect removal of unused toner. Toner which adheres to the distribution roller during application of voltage thereto is sprayed off and recovered for recycling, the spraying agent being toner dispersion.

U.S. Pat. No. 3,405,683 describes apparatus for the development of latent electrostatic images on an electrophotographic material with a liquid developer which includes means to feed the electrophotographic material through a pair of rotatable nip rolls and nozzle means adapted to simultaneously spray the electrostatic image and the nip roll which contacts the latent image.

SUMMARY OF THE INVENTION

It is a particular feature of the present invention that a highly efficient, simple and relatively low cost "instant" color change multicolor electrostatic imaging system is provided.

There is thus provided in a preferred embodiment of the invention a multicolor electrostatic imaging system including a movable electrostatic imaging surface, apparatus for providing an electrostatic image on the electrostatic image surface, a development electrode having a developer surface including contiguous portions and being in spaced relationship with the electrostatic imaging surface to form a development region and apparatus for moving the developer surface such that the contiguous portions of the developer surface sequentially enter the region at an entrance and exit the region at an exit, apparatus for providing a liquid developer of a selectable color to the development region at the exit, and apparatus for transferring the developed image to a substrate.

In a preferred embodiment of the invention the apparatus for providing a liquid developer includes multicolor spray apparatus having a multiplicity of spray outlets including a plurality of spray outlets, sequentially distributed among the multiplicity of spray outlets, for supplying liquid developer of each of a plurality of colors.

In a preferred embodiment of the invention the apparatus for providing a liquid developer supplies the liquid developer to the developer surface after it exits from the development region. Alternatively in a preferred embodiment of the invention the apparatus for providing a liquid developer supplies the liquid developer directly to the electrostatic imaging surface.

The imaging system includes, in a preferred embodiment of the invention, apparatus for moving the electrostatic imaging surface so that it enters the development region at the exit and leaves the region at the entrance. Additionally in a preferred embodiment of the invention the apparatus for providing a liquid developer supplies the liquid developer to the imaging surface before it enters the development region.

In a preferred embodiment of the invention the electrostatic imaging surface is cylindrical and the system also includes apparatus for moving the imaging surface with a velocity having a direction opposite of that of the developer surface at the development region.

There is further provided an imaging system including an imaging surface, apparatus for forming multiple electrostatic latent images sequentially on the imaging surface, development apparatus for sequentially developing the multiple electrostatic images with separate liquid developers, the development means including: a development electrode having a developer surface comprising contiguous portions and which is closely spaced from the electrostatic imaging surface to form a development region, apparatus for moving the developer surface such that the contiguous portions of the developer surface sequentially enter the region at an entrance and leave the region at an exit, apparatus means for sequentially supplying the separate liquid developers to the developing region to separately develop each of the multiple images and separate apparatus for removing residual amounts of each of the separate residual developers remaining on the surface of the development electrode after it exits the development region.

In a preferred embodiment of the invention the imaging apparatus also includes apparatus for reusing the residual developer after its removal from the development electrode.

In a preferred embodiment of the invention the separate means for removing includes a plurality of single color cleaning assemblies, each corresponding to a given one of a plurality of colors. The separate apparatus for removing includes in a preferred embodiment of the invention, a final cleaning assembly, downstream of the plurality of cleaning assemblies.

In a preferred embodiment of the invention the imaging system also includes single color toner receiving apparatus associated with at least one of the single color cleaning assemblies. In a preferred embodiment of the imaging system also includes apparatus communicating with the single color toner receiving apparatus for recycling single color toner to the apparatus for sequentially supplying. In a preferred embodiment of the invention, the single color cleaning assemblies include apparatus for selectably engaging the developing electrode. The cleaning assemblies include scraper blade means in a preferred embodiment of the invention.

In a preferred embodiment of the invention the apparatus for removing residual developer includes at least one resilient blade in contact with the development electrode.

There is further provided, in a preferred embodiment of the invention, imaging apparatus including an imaging surface, apparatus for forming an electrostatic latent image on the imaging surface and development apparatus for sequentially developing the electrostatic images with a liquid developer, the development means including: a development electrode having a developer surface comprising contiguous portions and which is closely spaced from the electrostatic imaging surface to form a development region, apparatus for moving the developer surface such that the contiguous portions of the developer surface sequentially enter the region at an entrance and leave the region at an exit and apparatus for providing the liquid developer to the development region to separately develop the images, wherein the liquid developer is in a turbulent state at the development region.

In a preferred embodiment of the invention the apparatus for providing the liquid developer supplies the liquid developer to the development region at the exit. In a preferred embodiment of the invention the liquid developer is sprayed on the developer surface after it exits the development region.

In a preferred embodiment of the invention the imaging surface includes contiguous portions which subsequently enter the development region at the exit and leave the development region at the entrance and wherein the means for providing the liquid developer includes spraying the liquid developer on the imaging surface before it enters the development region.

BRIEF DESCRIPTION OF THE DRAWINGS

The present invention will be understood and appreciated from the following detailed description, taken in conjunction with the drawings in which:

FIG. 13 is a side, sectional view of the spray apparatus for the embodiment of FIG. 11; and FIG. 14 is a perspective view of the spray apparatus for the embodiment of FIG. 11.

DETAILED DESCRIPTION OF PREFERRED EMBODIMENTS

Figure 1:
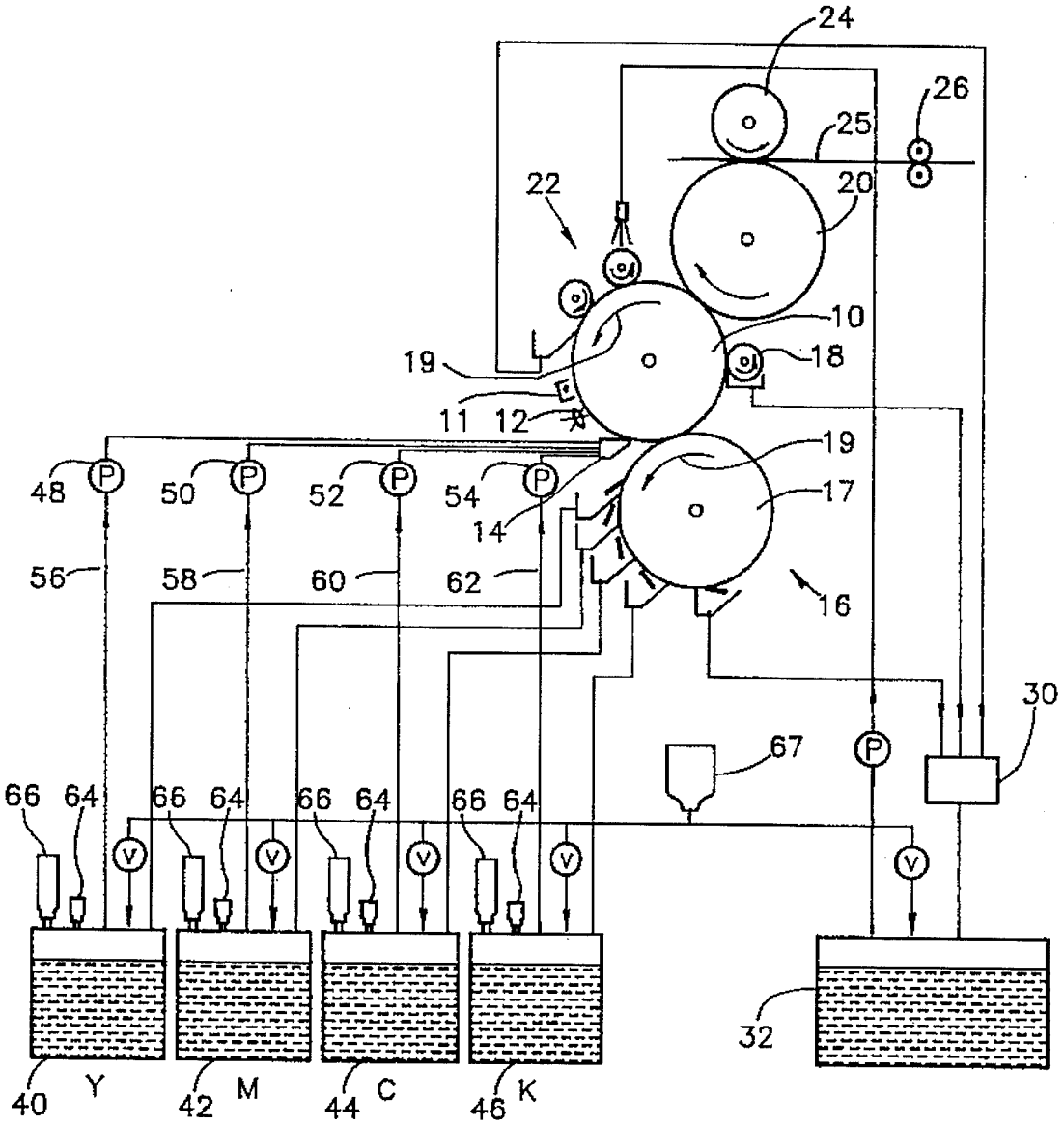
FIG. 1 is a generalized schematic illustration of an imaging system constructed and operative in accordance with a preferred embodiment of the present invention.

Reference is now made to FIG. 1 which illustrates a multicolor electrostatic imaging system constructed and operative in accordance with a preferred embodiment of the present invention. As seen in FIG. 1 there is provided an image bearing surface typically embodied in a rotating photoconductive drum 10. Operatively associated with photoconductive drum 10 is photoconductor charging apparatus 11 and imaging apparatus 12, for providing a desired latent image on drum 10. The latent image normally comprises image areas at a first electrical potential and background areas at another electrical potential.

Also associated with photoconductive drum 10 are a multicolor liquid developer spray assembly 14, a developing assembly 16, an excess liquid removal assembly 18, an intermediate transfer member 20 and a cleaning station 22.

The developing assembly 16 preferably comprises a developer roller 17 spaced from the photoconductive drum 10 and typically rotating in the same sense as drum 10, as indicated by arrows 19. This rotation provides for the surface of drum 10 and roller 17 to have opposite velocities in their region of propinquity.

Photoconductive drum 10, photoconductor charging apparatus 11 and imaging apparatus 12 may be any suitable drum, charging apparatus and imaging apparatus such as are well known in the art. Developing assembly 16 is of particular construction several embodiments of which are described in detail hereinbelow.

Excess liquid removal assembly 18 typically comprises a biased squeegee roller preferably formed of resilient conductive polymeric material, and is charged to a potential of several hundred to a few thousand volts with the same sign as the sign of the charge on the toner particles.

Intermediate transfer member 20 may be any suitable intermediate transfer member such as those described in U.S. patent application Ser. No. 306,062 filed Feb. 6, 1989, the disclosure of which is incorporated herein by reference, and is arranged for electrostatic transfer of the image from the image bearing surface. Intermediate transfer member 20 is associated with a pressure roller 24 for transfer of the image onto a further substrate 25, such as paper, preferably by heat and pressure. A fuser 26 may be associated with the substrate 25, for fixing the image thereon, if required. Cleaning station 22 may be any suitable cleaning station, such as that described in U.S. Pat. No. 4,439,035, the disclosure of which is hereby incorporated herein by reference.

In accordance with a preferred embodiment of the invention, after developing each image in a given color, the single color image is transferred to intermediate transfer member 20. Subsequent images in different colors are sequentially transferred onto intermediate transfer member 20. When all of the desired images have been transferred thereto, the complete multi-color image is transferred from transfer member 20 to substrate 25. Pressure roller 24 therefore only produces operative engagement between intermediate transfer member 20 and substrate 25 when transfer of the composite image to substrate 25 takes place.

Alternatively, each single color image is transferred to the paper after its formation. In this case the paper is fed through the machine once for each color or is held on a platen and contacted with the intermediate transfer member during image transfer. Alternatively, the intermediate transfer member is omitted and the developed single color images are transferred sequentially directly from drum 10 to substrate 25.

According to a preferred embodiment of the invention, excess liquid containing toner particles of various colors is collected from cleaning station 22, excess liquid removal assembly 18 and developer assembly 16 and supplied to a separator 30 which is operative to separate relatively clean carrier liquid from the various colored toner particles. The separator may typically be of the type described in U.S. patent application Ser. No. 319,124, filed Mar. 6, 1989, the disclosure of which is hereby incorporated herein by reference. Clean carrier liquid is supplied from separator 30 to a carrier liquid reservoir 32, which also may receive additional supplies of carrier liquid, as necessary. Carrier liquid from reservoir 32 is supplied to cleaning station 22.

Figure 2:
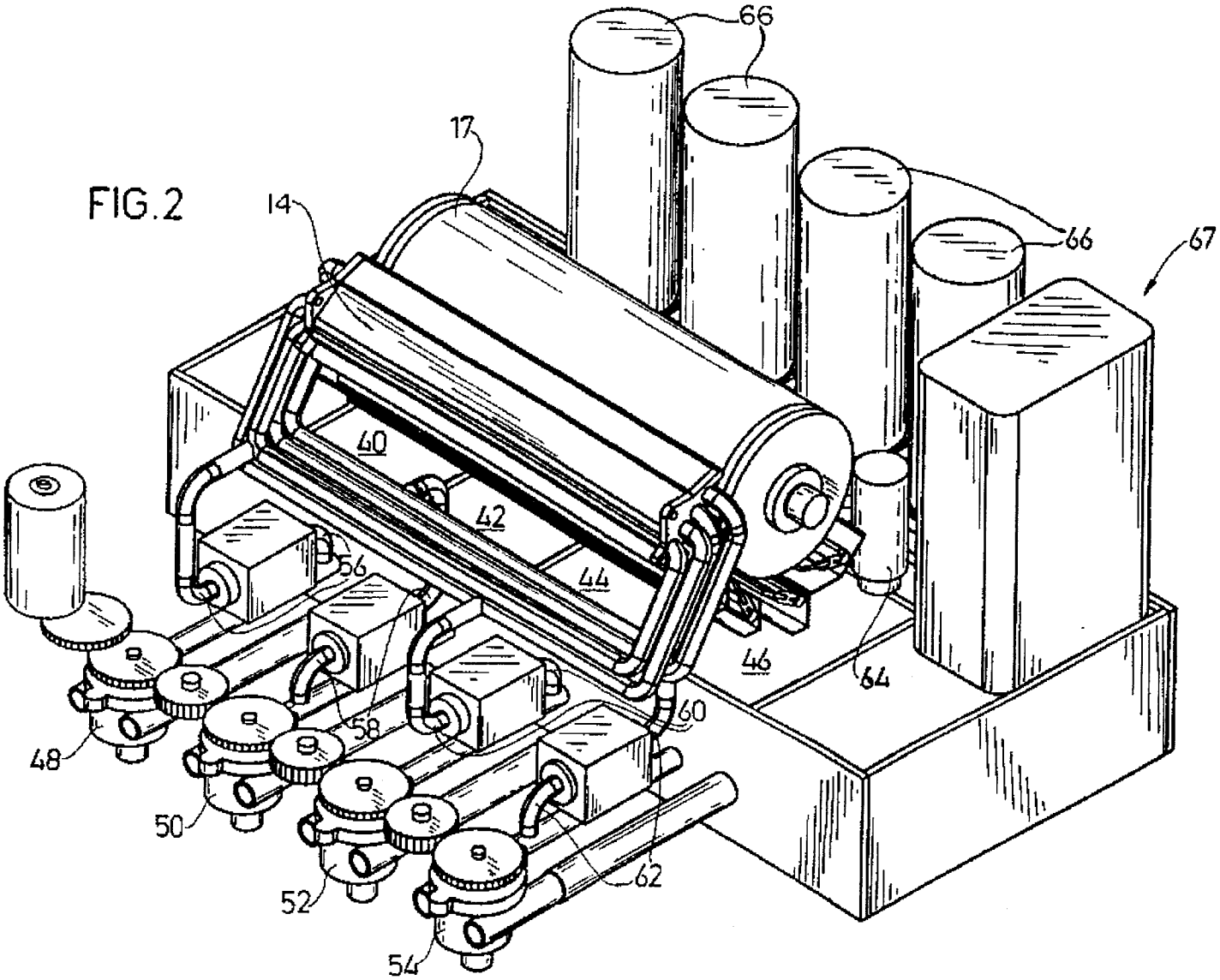
FIG. 2 is a pictorial illustration of a portion of the apparatus of FIG. 1.

Reference is now made additionally to FIG. 2, which is a pictorial illustration of part of the apparatus of FIG. 1, not including photoconductive drum 10, intermediate transfer member 20, roller 24, substrate 25 and fuser 26. It is seen in FIGS. 1 and 2 that multicolor toner spray assembly 14 receives separate supplies of colored toner from four different reservoirs 40, 42, 44 and 46, typically containing the colors Yellow, Magenta, Cyan and Black respectively. Pumps 48, 50, 52 and 54 may be provided along respective supply conduits 56, 58, 60 and 62 for providing a desired amount of pressure to feed the colored toner to multicolor spray assembly 14.

Associated with each of reservoirs 40, 42, 44 and 46 are typically provided containers of charge director and concentrated toner material, indicated respectively by reference numerals 64 and 66 as well as a supply of carrier liquid, indicated generally by reference numeral 67.

Each of the reservoirs 40, 42, 44 and 46 also typically receives an input of recycled toner of a corresponding color from developer assembly 16, which will be described hereinbelow in greater detail.

Figure 3:
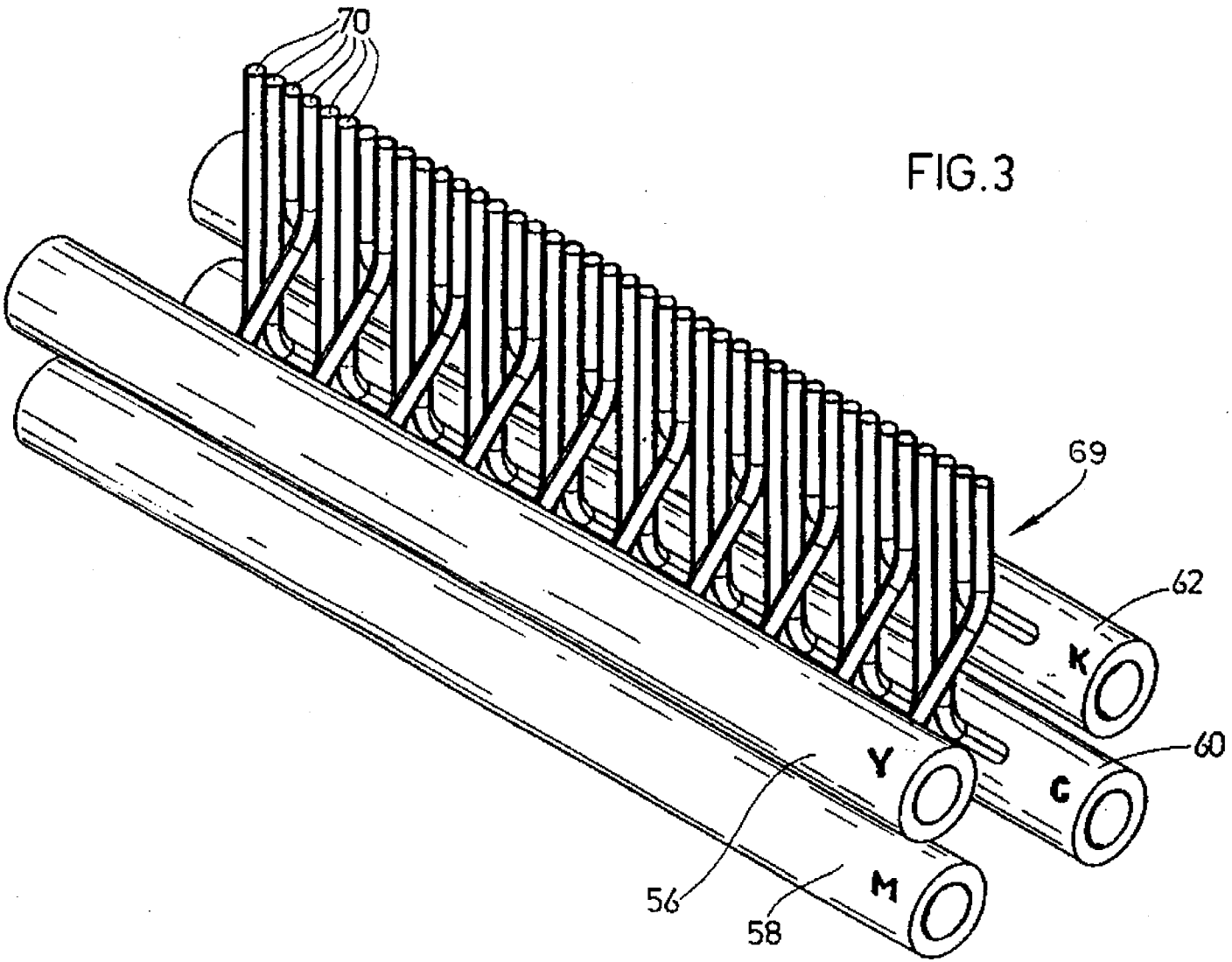
FIG. 3 is a pictorial illustration of one embodiment of spray apparatus employed in the present invention.

Reference is now made to FIG. 3 which illustrates one embodiment of a multicolor toner spray assembly indicated by reference number 69. In the embodiment of FIG. 3 it is seen that there is provided a linear array of spray outlets 70, each of which communicates with one of the four conduits 56, 58, 60 and 62. The spray outlets are preferably interdigitated such that every fourth outlet is of the same color and that every group of four adjacent outlets includes outlets of four different colors. The spacing of the spray outlets and their periodicity is selected to enable substantially complete coverage of the photoconductor to be realized for each given color separately.

Preferably the center to center spacing of the outlets is as small as possible. In the embodiment of FIG. 3, the center to center spacing of outlets 70 is typically 2 mm. The nozzle openings of the outlets are restricted to provide a desired flow configuration and preferably have a generally rectangular cross section. In any event, the amount of toner that is applied to the drum in accordance with the present invention is sufficient to provide a layer of toner of thickness at least sufficient to substantially fill the gap between drum 10 and developer roller 17.

It is a characteristic of preferred embodiments of the invention that developer roller 17 is a reverse roller, that is, the surfaces of developer roller 17 and drum 10 move in opposite directions at the development region. In the present invention the flow of liquid developer is high enough so that there is a substantial amount of liquid developer at the point of propinquity of drum 10 and roller 17 such that the toner is in a turbulent rather than laminar state. For reasons which are not clearly understood, this turbulent flow has resulted in excellent images. It is also believed that this turbulence allows for relatively high spacings between the spray outlets without substantial deterioration of image quality.

Reference is now made to FIGS. 4A and 4B and FIGS. 5A–5E, which together illustrate a preferred embodiment of the spray assembly indicated by reference number 81, which is composed of a predetermined sequence of modular elements 72, 74, 76, and 78 arranged in a stack.

Disposed in sealing engagement between each of the adjacent modular elements illustrated in FIGS. 5A–5D is a spacer element 84 (FIG. 5E), typically much thinner than the remaining modular elements, which seals the various spray outlets from each other and prevents color contamination.

It may be appreciated from a consideration of FIGS. 5A–5E, that each of the modular elements illustrated therein defines a part of four conduits corresponding to conduits 56, 58, 60 and 62 as well as two apertures 80 and 82 for accommodating connection and tightening bolts (not shown) which hold spray assembly 81 together.

Additionally each modular element has formed at one end a slit 86 which together with adjacent spacer elements 84 forms a rectangular spray outlet 90 each communicating via a respective channel 88 to respective conduits 56, 58, 60 and 62.

Figure 5A:
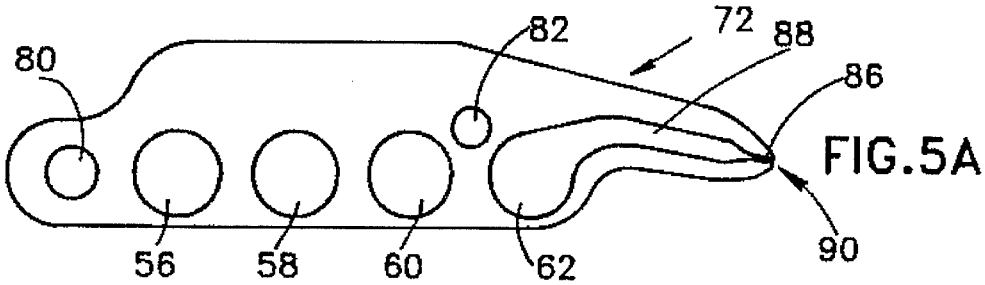
FIGS. 5A, 5B, 5C, 5D and 5E are sectional illustrations of modular sections of the spray apparatus of FIG. 4.
Figure 5B:
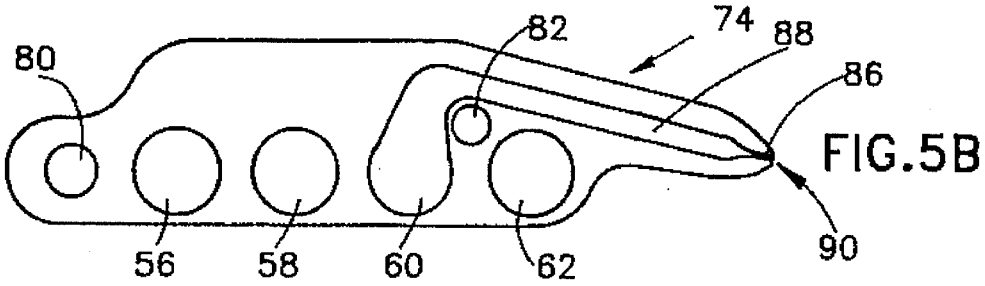
Figure 5C:
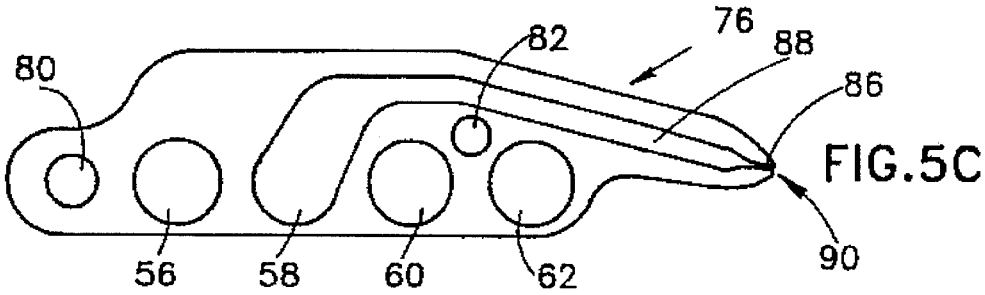
Figure 5D:
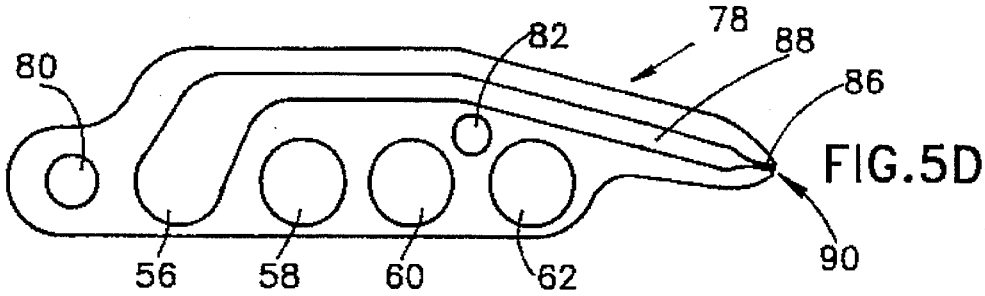
Figure 5E:
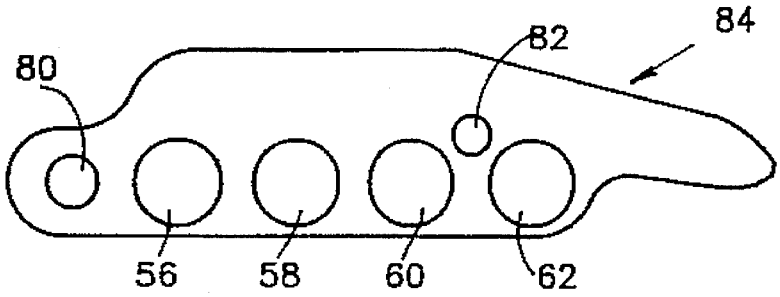

It may be appreciated that the modular element 72 illustrated in FIG. 5A corresponds to a spray outlet communicating with conduit 62, while the modular element 74 illustrated in FIG. 5B corresponds to a spray outlet communicating with conduit 60. The modular element 76 illustrated in FIG. 5C corresponds to a spray outlet communicating with conduit 58, while the modular element 78 illustrated in FIG. 5D corresponds to a spray outlet communicating with conduit 56.

Modular elements 72, 74, 76 and 78 are each typically of thickness 1 mm. This thickness defines one generally rectangular dimension of each spray outlet, whose other dimension, the width of slit 86, is normally selected to provide a desired application of toner to the drum 10 as described hereinabove. Spacer elements 84 typically have a thickness of 0.1 mm. Slit width is typically 0.6 mm.

It is a particular feature of the embodiment of FIGS. 4A–5E that relatively small spatial separations between adjacent spray outlets may be realized. For the typical dimensions mentioned above, the center to center spacing between adjacent outlets for the same color is 4.4 mm, while in the embodiment of FIG. 3, the corresponding spacing is 8 mm.

Reference is now made to FIG. 7 and FIGS. 8A–8D, which together illustrate a preferred alternative embodiment of a multicolor spray assembly which is indicated by reference number 15, similar to the embodiment illustrated in FIGS. 4A–4B and FIGS. 5A–5E and indicated by reference number 14. The major differences between the two embodiments are in the shape of the spray outlets and in the resultant change in the distance between the modular elements.

Figure 4A:
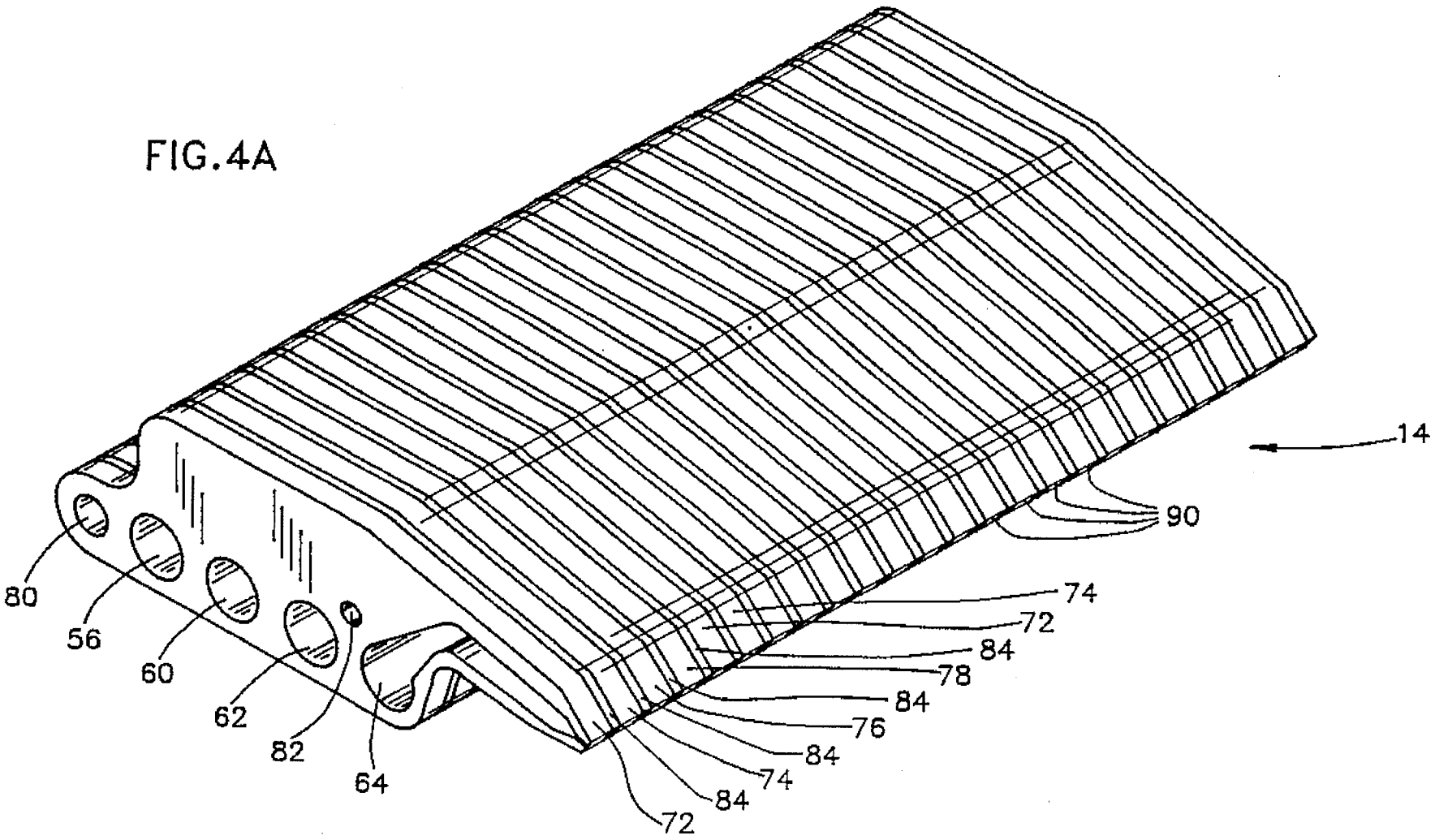
FIGS. 4A and 4B are respective pictorial and partially sectional illustrations of a preferred embodiment of spray apparatus employed in the present invention.
Figure 4B:
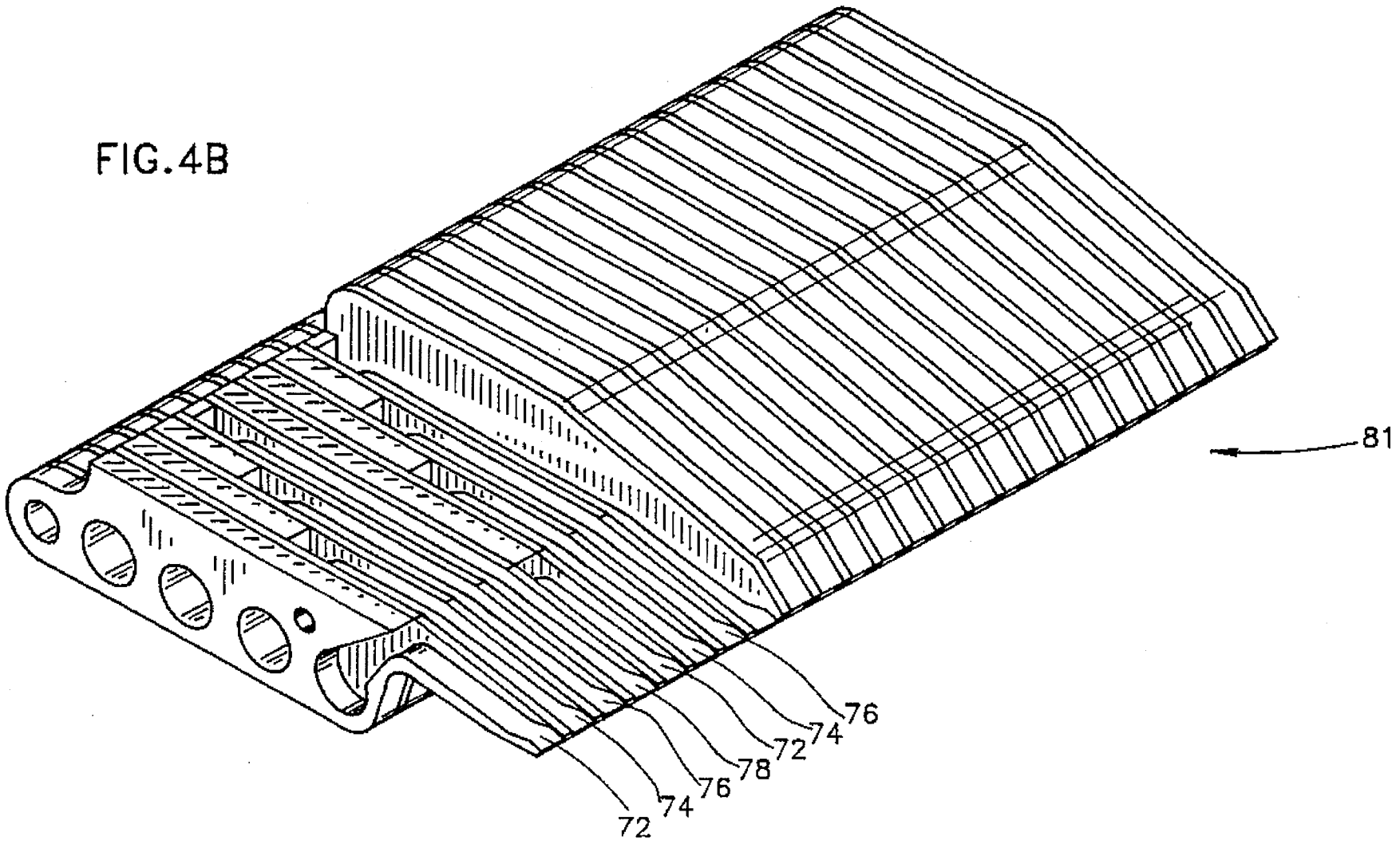

In the embodiment of FIGS. 4A and 4B, the spray outlet is rectangular and formed by the upper and lower walls of slit 86 and spacer elements 84 adjoining the modular element. The spray outlets for the embodiment of FIGS. 7 and 8A–8D is formed of a tubular extension 108 at the end of each modular element 110, 112, 114 and 116.

Modular elements 110, 112, 114 and 116 are each typically of thickness 2 mm. Tubular extensions 108 have a typical inner diameter of 1 mm and a typical outer diameter of 1.5 mm. Thus the spray outlet center to center spacing for this embodiment is typically 2.1 mm, compared to 1.1 mm for the embodiment of FIG. 4A and 4B, and the spacing between sprays of the same color is about 8.4 mm instead of 4.4 mm for the embodiment of FIGS. 4A and 4B.

The outer surfaces of tubular extensions 108 are tapered at their exit ends in order to reduce the wall thickness at the output face of the extensions to a minimum. It is believed that this reduction reduces dripping of the liquid developer.

Figure 6:
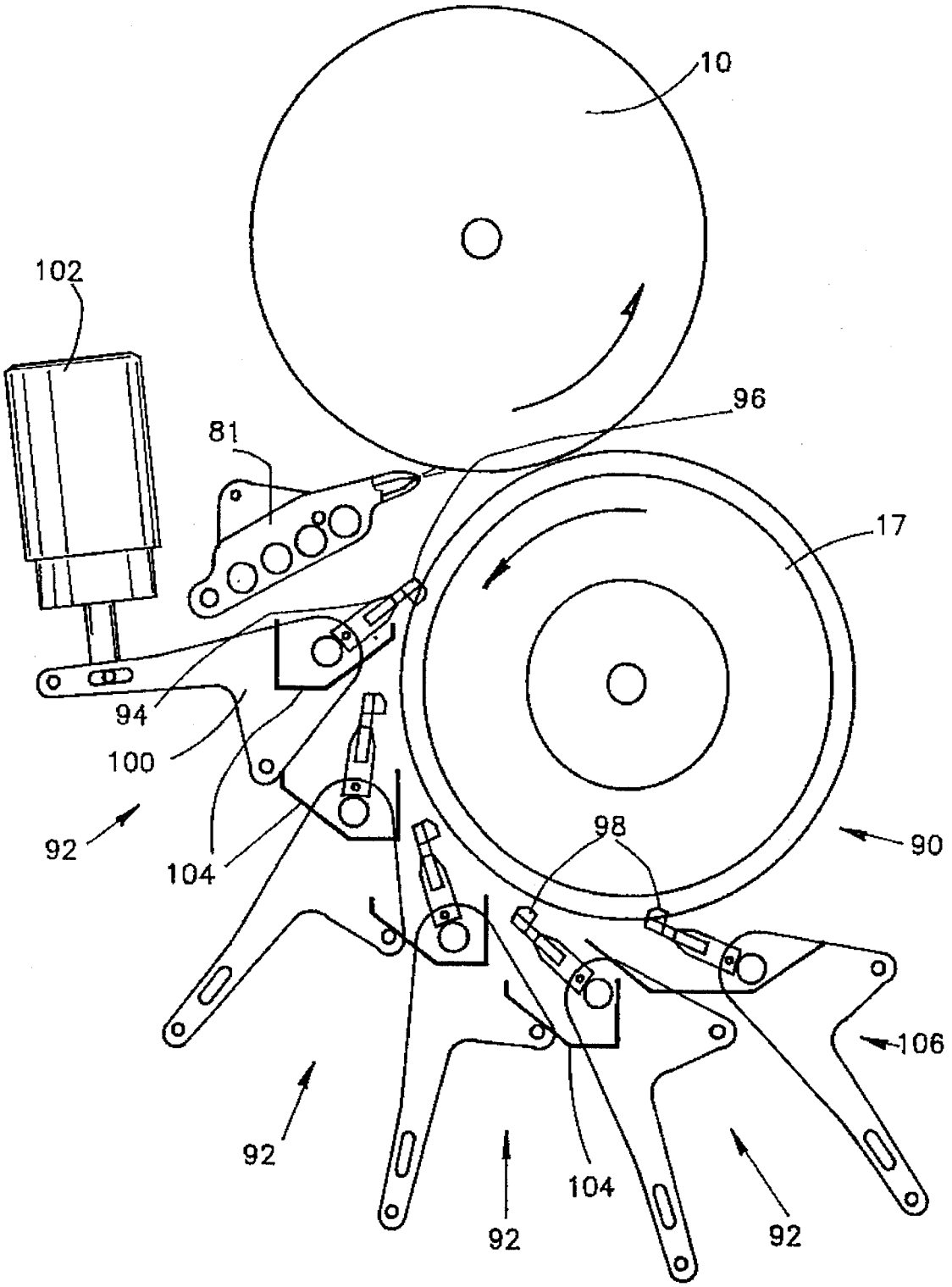
FIG. 6 is a sectional illustration of part of the apparatus of FIG. 1 which particularly illustrates a multicolor, non-contaminating developer assembly particularly useful in the present invention.

Reference is now made to FIG. 6 which illustrates a developer assembly 90 constructed and operative in accordance with a preferred embodiment of the invention. The developer assembly comprises developer roller 17 which operatively engages photoconductor drum 10 in spaced relationship therewith and, due to its rotation in the same sense as photoconductor drum 10, acts as a metering device. Developer roller 17 is typically maintained at +200 Volts when the voltage of the image areas of the photoconductor 10 is approximately +1000 Volts and the voltage on the background areas of the photoconductor 10 is approximately +100 Volts. The above voltages are suitable for the use of negatively charged toner and a selenium coated photoconductor drum. If it is desired to use a positively charged toner or another type of photoconductor material, correspondingly different voltages will be appropriate. This embodiment utilizes multicolor spray assembly 14, illustrated in FIGS. 4A–4B and 5A–5E and the spray is directed toward the under surface of photoconducting drum 10.

Figure 7:
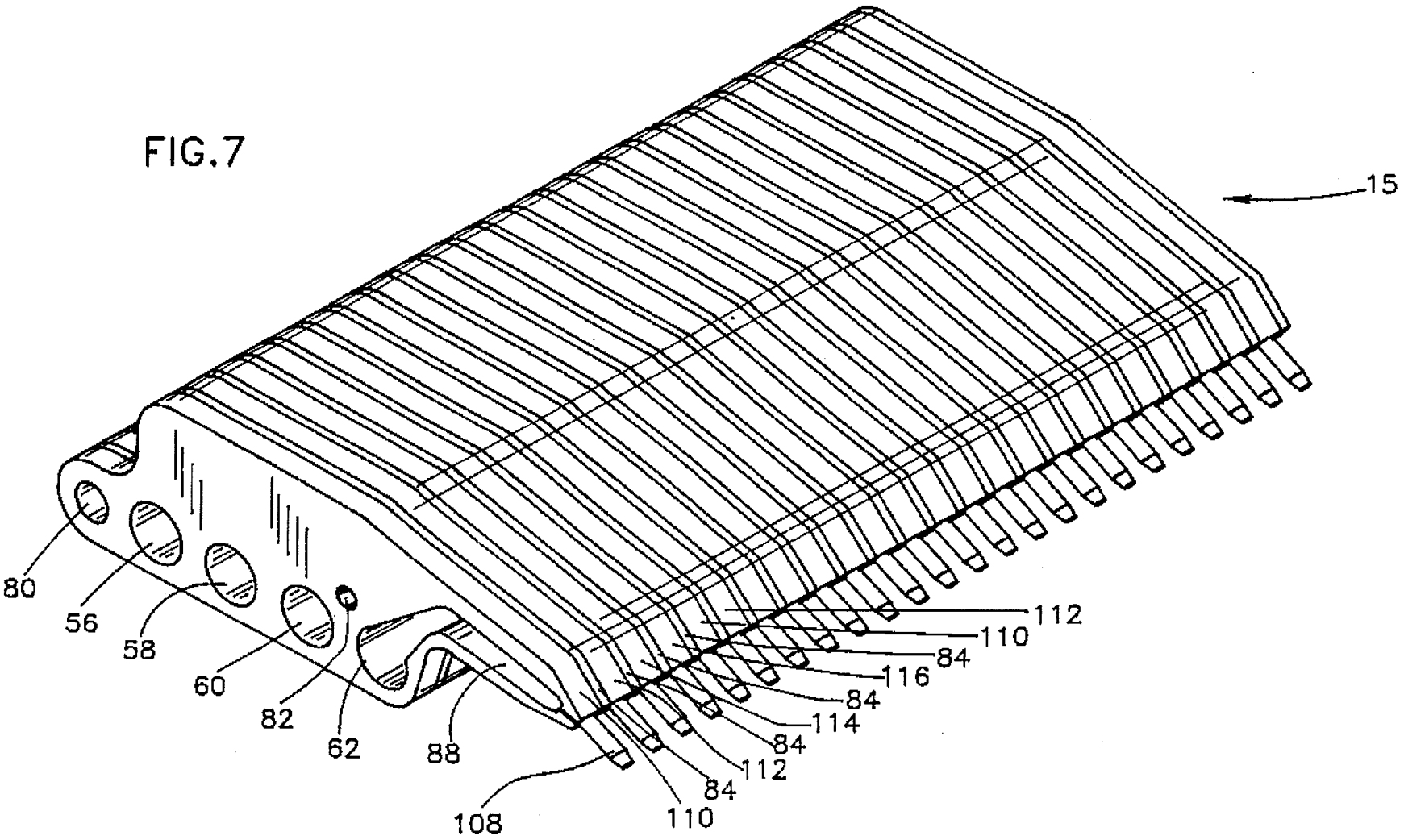
FIG. 7 is a pictorial illustration of an alternative embodiment of the spray apparatus employed in the present invention.
Figure 8A:
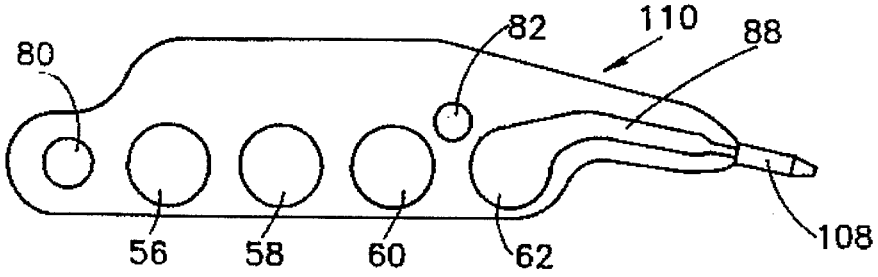
FIGS. 8A, 8B, 8C and 8D are sectional illustrations of modular sections of the spray apparatus of FIG. 7.
Figure 8B:
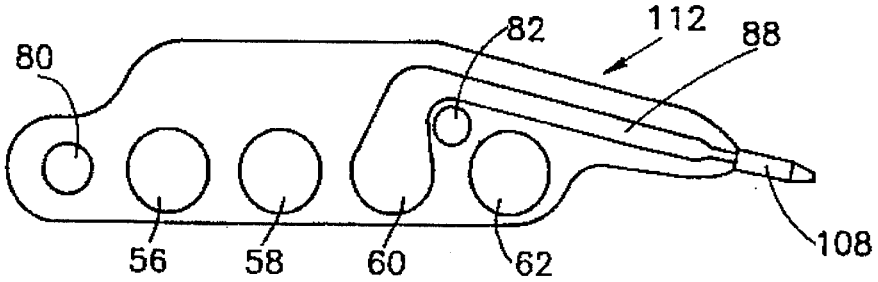
Figure 8C:
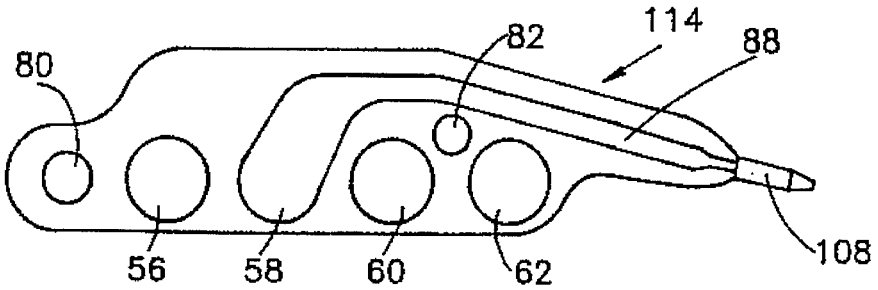
Figure 8D:
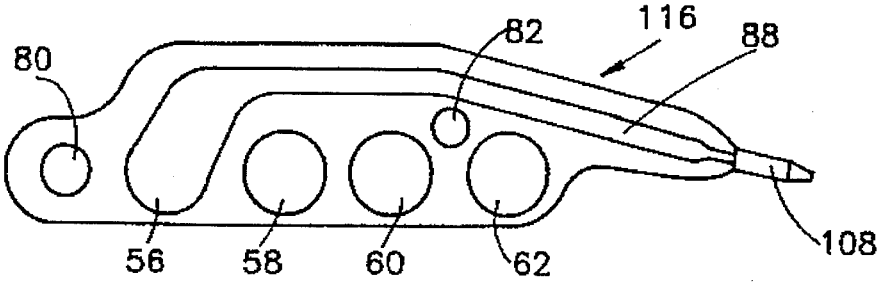
Figure 9:
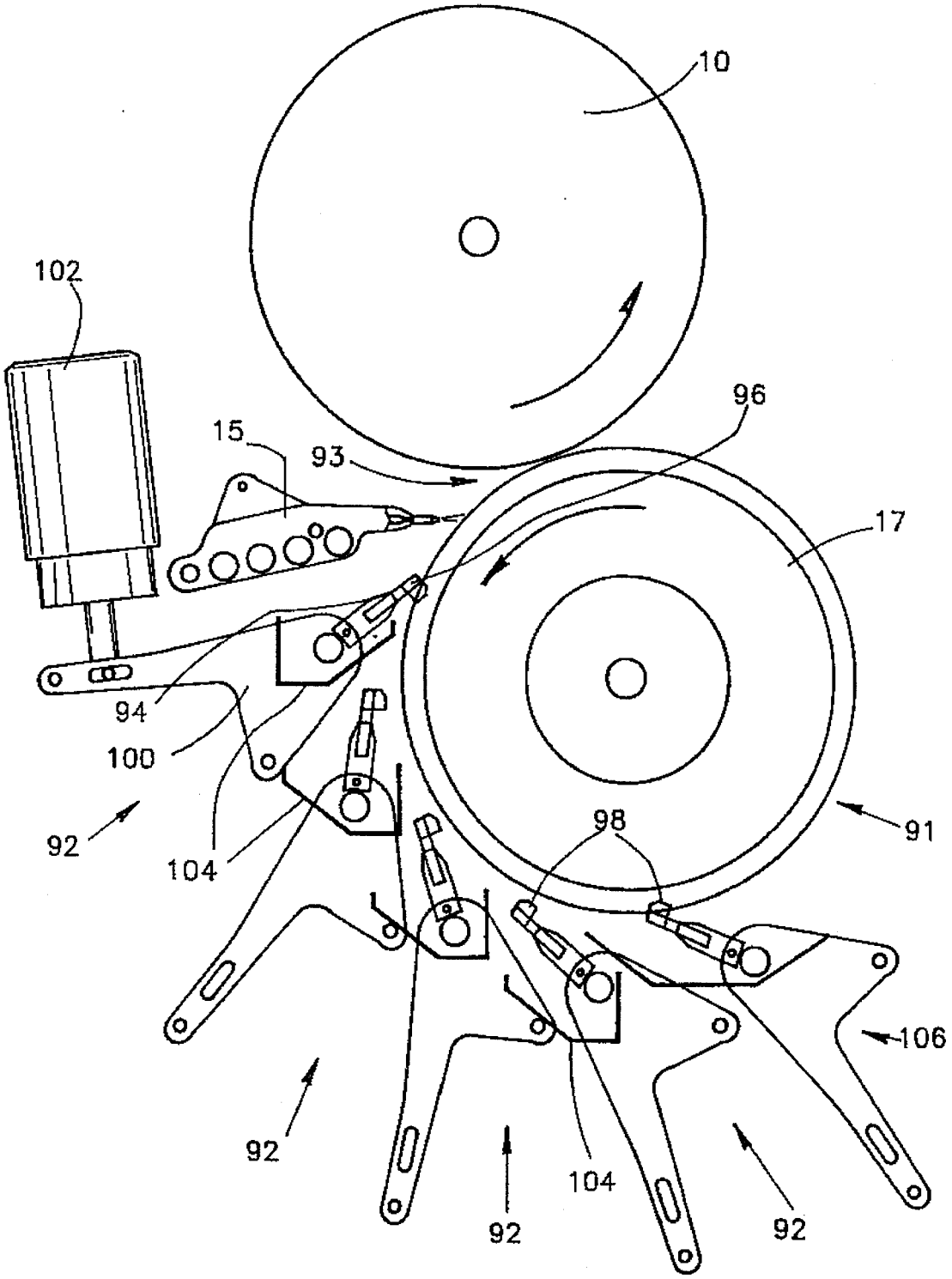
FIG. 9 is a sectional illustration of part of the apparatus of FIG. 1 utilizing the spray apparatus of FIG. 7 and which particularly illustrates a multicolor, non-contaminating developer assembly particularly useful in the present invention.

FIG. 9 illustrates a different preferred embodiment of the invention with a developer assembly 91, similar to that of FIG. 6, but utilizing spray assembly 15 of FIG. 7. Here the spray is directed to the upper surface of developer roller 17. It should be noted that the rotation of developer roller 17 is such as to carry the developer liquid away from a development region 93. Nevertheless the multicolor spray assembly produces a sufficient amount of force to assure that there is a supply of liquid developer at the development region as will be illustrated with the aid of FIG. 10.

Figure 10:
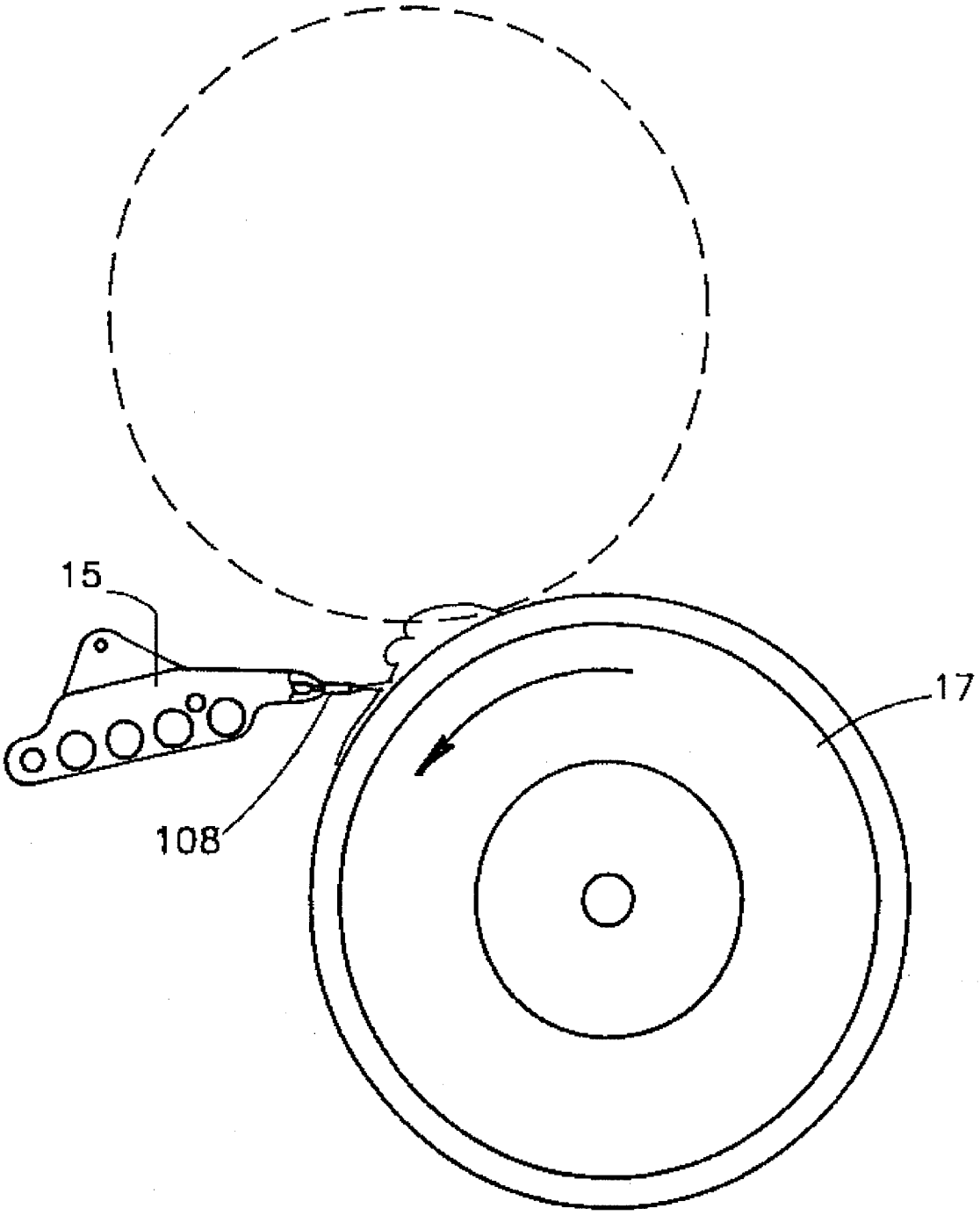
FIG. 10 is a sectional illustration of the build-up of liquid developer on the developer roller in the absence of the photoconductor drum.

In FIG. 10 photoconductive drum 10 is shown in phantom and liquid developer sprayed from the tubular extension is seen to form in its absence a thick accumulation of developer. It is now understood that the net effect of the spray, and the movement of developer roller 17 and photoconducting drum 10 is to form development region 93 filled with developer at the point of propinquity of drum 10 and roller 17 and to the left of that point. The amount of developer in that region and its extent is easily changed by varying the rotation speeds of drum 10 and roller 17 and the amount of liquid developer supplied.

Very little liquid carries through to the right of the development region due to the metering effect of developer roller 17. It is also clearly understood that for this embodiment as well as for the others disclosed herein, there is substantial turbulence of the liquid developer in the development region.

For both the embodiments of FIG. 6 and FIG. 9 it is seen that the toner at the developer interface is removed from the development region quickly after the flow is interrupted. This allows for almost instant change of developer color at development region 93.

A preferred type of toner for use with the present invention is that described in Example 1 of U.S. Pat. No. 4,794,651, the teachings of which are incorporated herein by reference. Other toners may alternatively be employed. For colored liquid developers, carbon black is replaced by color pigments as is well known in the art.

Operatively associated with developer roller 17 are a plurality of color specific toner cleaning assemblies 92, each of which is selectably brought into operative association with developer roller 17 only when toner of a color corresponding thereto is supplied to development region 93 by spray assembly 14.

Each of cleaning assemblies 92 comprises a blade member 94 including a preferably resilient main portion 96 and side wiping portions 98 arranged to engage the two edges of the roller developer surface. Blade member 94 is mounted on a linkage 100 which is selectably positioned by a conventional actuator 102. Associated with each of the cleaning assemblies 92 is a toner collection member 104 which serves to collect the toner removed by the cleaning assembly 92 from the developing electrode and thus to prevent contamination by mixing of the various colors.

As noted above, the toner collected by collection members 104 is recycled to the corresponding toner reservoirs. A final toner collection member 106 always engages the developer roller 17. The toner collected thereby is supplied to separator 30 (FIG. 1). Alternatively the toner collected by collection member 106 may be supplied directly to the black (K) toner reservoir 46.

Figure 11:
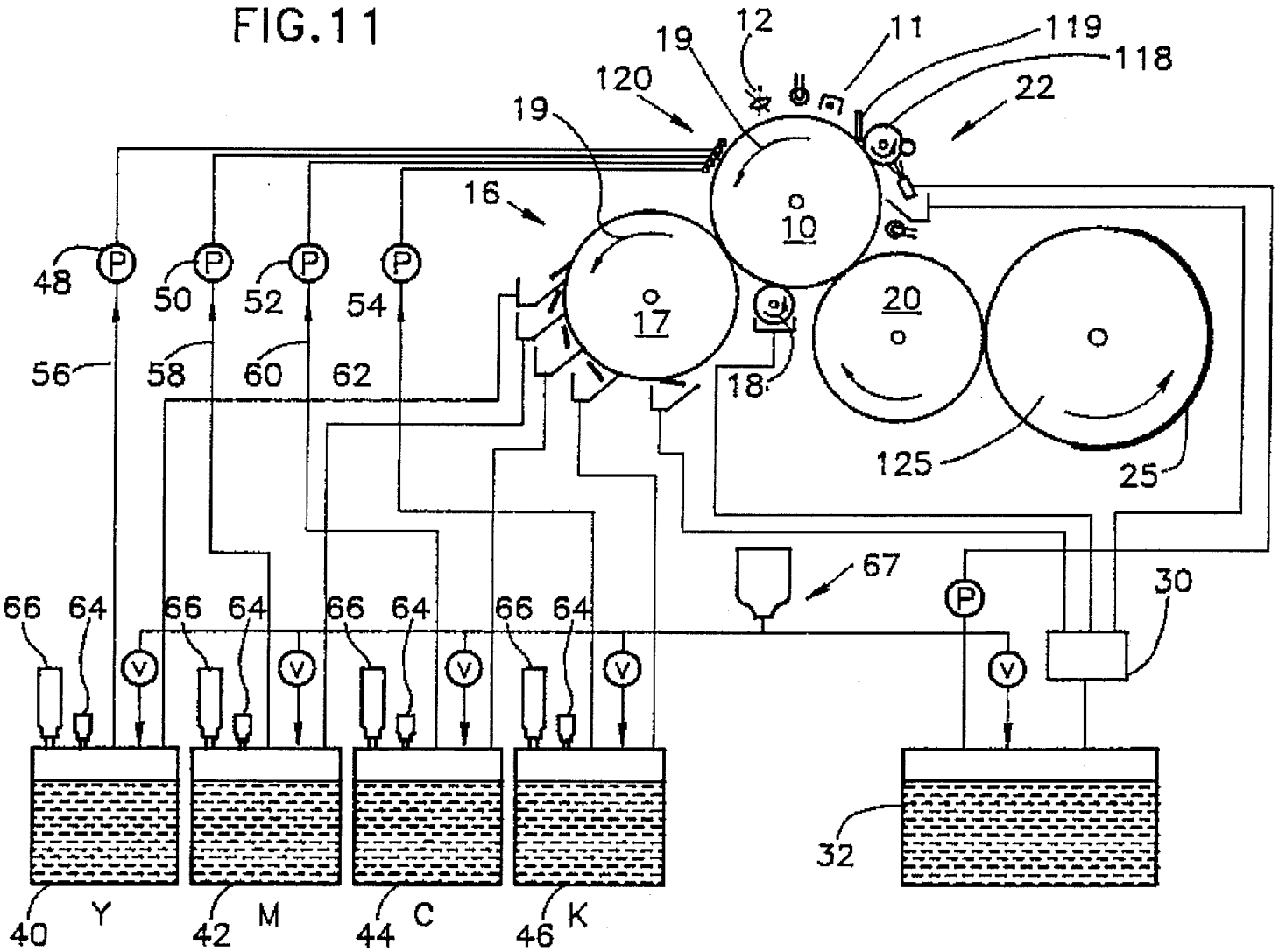
FIG. 11 is a generalized schematic illustration of an imaging system constructed and operative in accordance with another preferred embodiment of the present invention.
Figure 12:
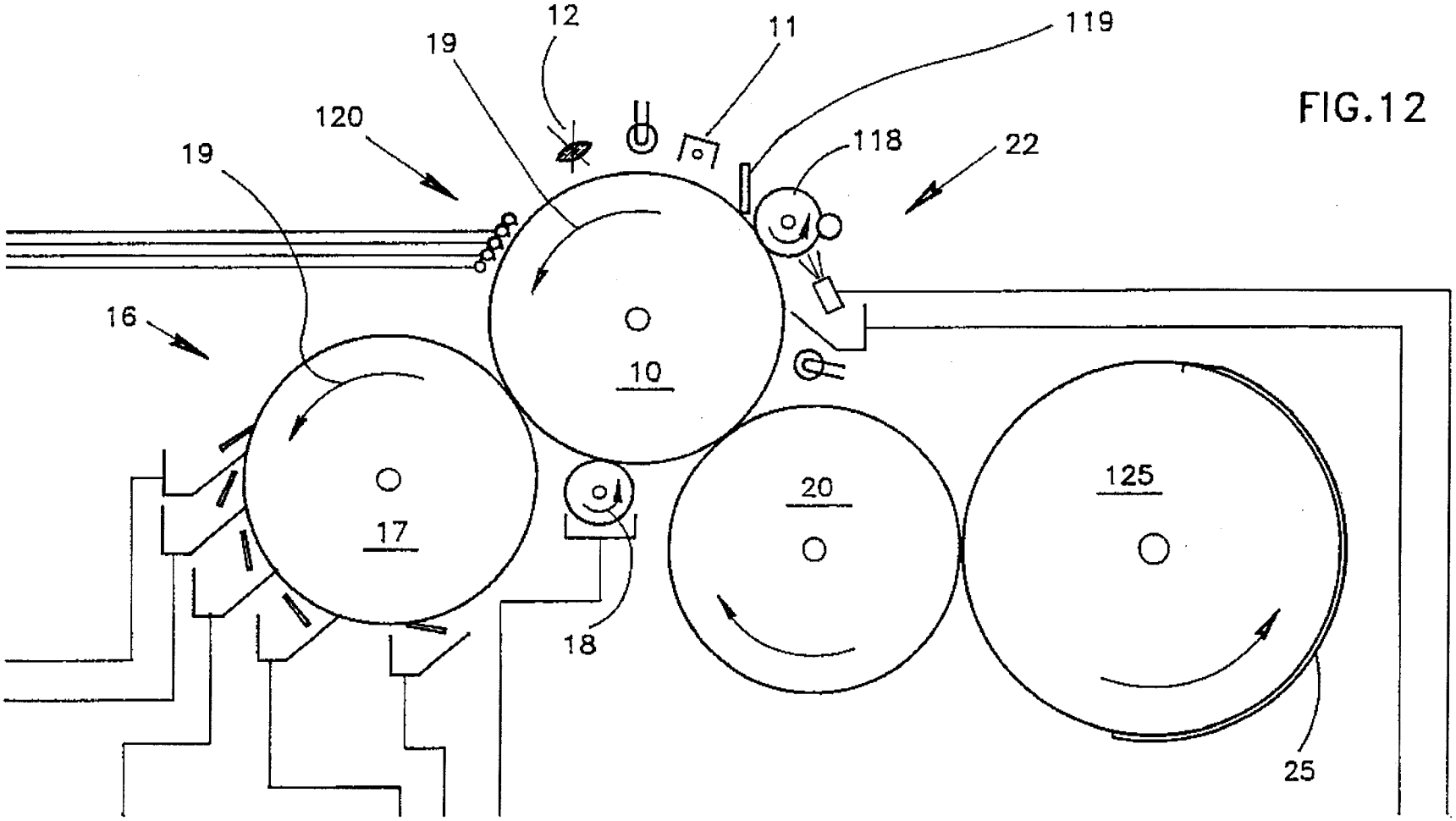
FIG. 12 is a enlarged view of a portion of FIG. 11.

An alternative preferred embodiment of the invention is shown in FIGS. 11–14. FIG. 11 shows a general cross-sectional schematic view of the system. The liquid handling is similar to that of the previous embodiments with the changes therefrom mainly in the development and image transfer regions. These changes are shown more clearly in FIG. 12 which is an enlarged view of the relevant portion of FIG. 11. In FIGS. 11 and 12 functionally unchanged elements are referenced with the same reference numbers as used in earlier drawings illustrating the other embodiments of the invention.

In the embodiment of FIGS. 11 and 12 developer roller 17 is approximately at 7:30 o'clock in relation to drum 10 and a multicolor spray assembly 120 is at approximately 10 o'clock. Cleaning station 22 utilizes a wetted sponge roller 118 followed by a resilient blade 119.

Multicolor spray assembly 120 comprises a linear spray assembly for each of the colors. Unlike the embodiments of spray assembly 14, spray outlets 121 do not form a linear array for all of the colors, but rather each linear color array is displaced from its neighbors both axially and in the process direction. This arrangement is shown most clearly in FIGS. 13 and 14.

Spray outlets 121 spray downward onto a downward moving portion of photoconductive drum 10 and are formed with a bend which changes the direction of flow from generally upward at the connection to supply conduit manifolds 124, 126, 128 and 130 respectively to an downward angle at the exits from spray outlets 121. This change in direction has been found to reduce dripping from the exits of the spray outlets when the color is changed, which is important to reduce the time required between color changes. Supply conduit manifolds 124, 126, 128 and 130 are continuations of supply conduits 56, 58, 60 and 62 and are fed with liquid toner preferably from both ends.

In a preferred embodiment of the invention the supply conduits are fed by elastic tubing in order to allow for faster cut-off of the flow.

In the embodiment of the invention shown in FIGS. 11 and 12, substrate 25 is held on a backing roller 125. The apparatus can operate in two ways. In both cases the individual color images are formed and sequentially developed on drum 10 and sequentially transferred to intermediate transfer member 20. In the first preferred embodiment of the invention the images are all transferred to intermediate transfer member 20 in registration and then the complete multicolor image is transferred as a whole to substrate 25. In the second preferred embodiment the single color images are transferred individually to substrate 25 without being assembled as a group on intermediate transfer member 20.

It is understood that in some preferred embodiments of the present invention the multicolor spray assemblies spray onto a downward facing portion of photoconductor drum 10. The spray may be upward or with an upward directional component, as shown in FIG. 1. For other embodiments of the invention the spray direction may be horizontal or alternatively the spray direction may have a downward component or it may be directed at developer roller 17. It is a further feature of a preferred embodiment of the invention that the multicolor spray assembly is operative to provide a plurality of jets of toner whose cross sectional extent upon impingement with the drum does not significantly exceed the cross sectional of the opening of each spray nozzle.

It is a further characteristic of the illustrated preferred embodiments of the invention that developer roller is a reverse roller and that the liquid developer is supplied to a development region comprising the side of the region of propinquity between roller 17 and drum 10 at which roller 17 leaves that region. This has a number of effects. Firstly, if sufficient liquid developer is supplied, the liquid developer is in a turbulent state which is believed to reduce the close spacing requirement for the spray nozzles.

Development takes place in this development region and the developer roller 17 carries excess carrier liquid away from the development region for reuse. Additionally, roller developer 17 also acts as a metering roller, so that the amount of liquid remaining on the background areas of the image on drum 10 when it leaves the development area is reduced and loosely adhering toner on the image which tends to reduce image quality is removed and carried away by development roller 17.

While the invention has been described utilizing a roller developer, it is understood that the invention can be practiced utilizing a belt developer.

It will be appreciated by persons skilled in the art that the present invention is not limited by what has been particularly shown and described hereinabove. Rather the scope of the present invention is defined only by the claims which follow:

We claim:

1. An imaging system comprising:

a movable electrostatic imaging surface;

means for providing an electrostatic image of said electrostatic image surface;

a development electrode having a developer surface comprising contiguous portions and being in spaced relationship with said electrostatic imaging surface to form a development region therebetween;

means for moving said developer surface such that said contiguous portions of said developer surface sequentially enter said development region at an entrance and leave said development region at an exit;

means for moving said electrostatic imaging surface so that it enters said development region at said exit and leaves said region at said entrance;

means for providing a liquid developer of a selectable color to said development region at said exit thereby to develop said electrostatic image and form a developed image on said imaging surface; and means for transferring said developed image to a substrate.

2. An imaging system according to claim 1 wherein said means for providing a liquid developer comprises:

multicolor supply means comprising a multiplicity of outlets including a plurality of outlets sequentially distributed among said multiplicity of spray outlets, for supplying liquid developer of each of a plurality of colors.

3. An imaging system according to claim 2 wherein said means for providing a liquid developer supplies said liquid developer directly onto said electrostatic imaging surface.

4. An imaging system according to claim 1 wherein said means for providing a liquid developer supplies said liquid developer directly onto said developer surface after it leaves said development region.

5. An imaging system according to claim 1 wherein said electrostatic imaging surface comprises a cylindrical surface.

6. Apparatus according to claim 1 wherein said development electrode is situated generally below the imaging surface.

7. Apparatus according to claim 1 wherein said development surface is operative to remove liquid developer from the development region.

8. A multicolor imaging system comprising:

an imaging surface;

means for sequentially forming multiple electrostatic latent images on said imaging surface;

a development electrode having a developer surface comprising contiguous portions and which is closely spaced from said imaging surface to form a development region, means for moving said developer surface such that said contiguous portions of said developer surface sequentially enter said region at an entrance and leave said region at an exit;

means for moving said imaging surface so that contiguous portions of said imaging surface enter said region at said exit and exit from said region at said entrance;

means for sequentially supplying separate liquid developers to said developing region to separately develop each of said multiple images; and means for transferring said multiple developed image to a substrate, wherein said means for sequentially supplying includes means for supplying said liquid developers to said developing region at said exit.

9. Apparatus according to claim 8 wherein said means for sequentially supplying supplies said liquid developers directly onto said developer electrode.

10. A method for forming an image comprising:

providing an electrostatic image on an imaging surface;

providing a liquid developer of a selectable color to a development region to develop said electrostatic image and form a developed image on said imaging surface, said development region being formed between the imaging surface and a development electrode having a developer surface comprising contiguous portions and being in spaced relationship with said imaging surface;

moving said developer surface such that said contiguous portions of said developer surface sequentially enter said region at an entrance and leave said development region at an exit;

moving said electrostatic imaging surface so that it enters said development region at said exit and leaves said region at said entrance; and transferring said developed image to a substrate.

11. A method according to claim 10 wherein said step of providing a liquid developer comprises supply said liquid developer directly onto said developer surface after it leaves said development region.

12. A method for forming multicolor images comprising:

sequentially forming multiple electrostatic latent images on a imaging surface;

sequentially supplying separate liquid developers to a development region to separately develop each of said multiple images, said development region being formed between the imaging surface and a development electrode having a developer surface comprising contiguous portions and which is closely spaced from said imaging surface thereby sequentially forming multiple developed images on said imaging surface;

moving said developer surface such that said contiguous portions of said developer surface sequentially enter said region at an entrance and leave said region at an exit;

moving said imaging surface so that contiguous portions of said imaging surface enter said region at said exit and leave said region at said entrance; and transferring said multiple developed images to a final substrate wherein said step of sequentially supplying includes supplying said liquid developers to said developing region at said exit.

13. A method according to claim 12 wherein said step of sequentially supplying includes supplying said liquid developers directly onto said development electrode.

14. An imaging system comprising:

a movable electrostatic imaging surface;

means for providing an electrostatic image on said electrostatic image surface;

a development electrode having a developer surface comprising contiguous portions and being in spaced relationship with said electrostatic imaging surface to form a development region therebetween;

means for moving said developer surface such that said contiguous portions of said developer surface sequentially enter said region at an entrance and leave said development region at an exit;

means for moving said electrostatic imaging surface so that it enters said development region at said exit and leaves said region at said entrance;

means for providing a liquid developer to said development region by providing said developer directly to said developer surface after it exits from said development region thereby developing said electrostatic image to form a developed image on said imaging surface; and means for transferring said developed image to a substrate.

15. Imaging apparatus comprising:

a movable electrostatic imaging surface;

means for providing an electrostatic image on said electrostatic imaging surface;

a development electrode having a developer surface comprising contiguous portions and being in spaced relationship with said electrostatic imaging surface to form a development region therebetween;

means for moving said developer surface such that said contiguous portions of said developer surface sequentially enter said region at an entrance and leaves said development region at an exit;

means for moving said electrostatic imaging surface so that it enters said development region at said exit and leave said region at said entrance;

means for providing a liquid developer to said development region by providing said developer directly to said developer surface at said exit thereby developing said electrostatic image and form a developed image on said imaging surface; and means for transferring said developed image to a substrate.

16. A method for forming an image comprising:

providing an electrostatic image on an imaging surface;

providing a liquid developer to a development region to develop said electrostatic image and form a developed image, said development region being formed between the imaging surface and a development electrode having a developer surface comprising contiguous portions and being in spaced relationship with said imaging surface;

moving said developer surface such that said contiguous portions of said developer surface sequentially enter said region at an entrance and leave said development region at an exit;

moving said electrostatic imaging surface so that it enters said development region at said exit and leaves said region at said entrance; and transferring said developed image to a substrate, wherein said step of providing a liquid developer comprises providing the liquid developer directly to the surface of the development electrode after it leaves said development region.

* * * * *